US006257855B1

(12) United States Patent
Kameya et al.

(10) Patent No.: US 6,257,855 B1
(45) Date of Patent: Jul. 10, 2001

(54) SCREW FLUID MACHINE

(75) Inventors: Hirotaka Kameya, Tsuchiura; Shigekazu Nozawa, Shimizu; Masayuki Urashin, Shimizu; Takeshi Hida, Shimizu; Masakazu Aoki, Shimizu, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/442,467

(22) Filed: Nov. 18, 1999

(30) Foreign Application Priority Data

Nov. 19, 1998 (JP) ..... 10-329067

(51) Int. Cl.[7] ..... F03C 2/00
(52) U.S. Cl. ..... 418/201.3
(58) Field of Search ..... 418/201.3

(56) References Cited

U.S. PATENT DOCUMENTS

| | | | | |
|---|---|---|---|---|
| 3,423,017 | * | 1/1969 | Schibbye | 418/201.3 |
| 3,622,256 | * | 11/1971 | Borisoglebsky et al. | 418/201.3 |
| 4,140,445 | * | 2/1979 | Schibbye | 418/201.3 |
| 4,350,480 | * | 9/1982 | Bammert | 418/201.3 |
| 4,401,420 | * | 8/1983 | Kasuya et al. | 418/201.3 |
| 4,412,796 | * | 11/1983 | Bowman | 418/201.3 |
| 4,435,139 | * | 3/1984 | Astberg | 418/201.3 |
| 4,460,322 | * | 7/1984 | Schibbye et al. | 418/201.3 |
| 4,508,496 | * | 4/1985 | Bowman | 418/201.3 |
| 4,576,558 | * | 3/1986 | Tanaka et al. | 418/201.3 |
| 4,583,927 | * | 4/1986 | Shigekawa | 418/201.3 |

FOREIGN PATENT DOCUMENTS

| | | | | |
|---|---|---|---|---|
| 146481 | * | 2/1981 | (DE) | 418/201.3 |
| 301201 | * | 10/1992 | (DE) | 418/201.3 |
| 57-059092 | * | 4/1982 | (JP) | 418/201.3 |
| 59-029794 | * | 2/1984 | (JP) | 418/201.3 |
| 63-205483 | * | 8/1988 | (JP) | 418/201.3 |
| 64-045989 | * | 2/1989 | (JP) | 418/201.3 |
| 5-195972 | * | 8/1993 | (JP) | 418/201.3 |

* cited by examiner

*Primary Examiner*—Thomas Denion
*Assistant Examiner*—Theresa Trieu
(74) *Attorney, Agent, or Firm*—Antonelli, Terry, Stout & Kraus, LLP

(57) ABSTRACT

A screw rotor for use in screw compressors and screw vacuum pumps comprises a pair of rotors including a male rotor and a female rotor. These rotors have helical lobes in an axial direction and mesh with each other to form a compression chamber. Depending upon a lobe configuration of the rotors, suction pressure and discharge pressure, a negative torque for self-rotation as well as a positive torque opposing to rotation due to a compression action is generated on the female rotor in operation. This phenomenon generates when a value obtained by integrating a torque acting on the female rotor over an entire cross section in an axial direction of the rotors becomes negative. When the negative torque is generated, noises due to tooth separating vibration is caused. Then, a lobe profile is defined such that a magnitude of the negative torque is smaller than that of the positive torque in respective cross sections of the female rotor. That is, a relationship between a radius of a point of contact on a leading surface side of the female rotor and a radius of a point of contact on a trailing surface side or curvatures of the rotors are such that the negative torque is not generated on the lobe profile.

9 Claims, 6 Drawing Sheets

SCREW FLUID MACHINE

BACKGROUND OF THE INVENTION

The invention relates to a screw fluid machine such as screw compressors, screw vacuum pumps and the like, and particularly to a screw fluid machine suitable for reducing noises.

In a twin screw compressor among screw fluid machines, it has become a significant problem to prevent noises generated by a phenomenon called "tooth separating vibration". With such twin screw fluid machines, a male rotor is made on a drive side, and lobe faces of a female rotor and the male rotor are made to come into contact with each other to drive the female rotor. Apart from this, non-contact type screw fluid machines have been often used, in which timing gears are provided on axial ends of each of the male rotor and the female rotor to mesh with each other to transmit torque. In addition, the lobe faces of the timing gears, which transmit torque, also continue to contact with each other.

Depending upon lobe profiles of the rotors and a condition of pressures acting on the lobe faces of the rotors, circumstances may happen, in which a gas torque acting on the female rotor temporarily becomes negative (here, a gas torque acting in a direction for promoting rotation is made negative), whereby there is generated a state, in which two lobe faces in torque transmitting relationship will move in relatively opposite directions. When the transmission torque again becomes positive, the lobe faces having been temporarily spaced apart from each other come to collide with each other. This phenomenon is called as tooth separation, and large vibrations and noises resulted from such repetitive tooth separation and collision are called as "tooth separating vibration".

Since large vibrations and great noises are caused by tooth separation, there have been suggested some methods of preventing the tooth separation. For example, Japanese Patent Unexamined Publication No. 5-195972 defines some conditions on lobe profiles, a rotation transmission error between rotors, and between moments of inertia on the respective rotors and rotor lobe faces, in order to prevent a transmission torque from the male rotor to the female rotor from becoming negative. Japanese Patent Unexamined Publication No. 2-252991 describes another example for preventing the tooth separation. In this example, configuration of lobe faces of a screw rotor is defined so that a transmission torque from a male rotor to a female rotor always becomes negative.

However, Japanese Patent Unexamined Publication No. 5-195972 mentioned above defines the conditions for prevention of tooth separation but does not disclose any concrete rotor configuration for satisfying the conditions, and so it is unclear what rotors can realize tooth separation. Also, Japanese Patent Unexamined Publication No. 2-252991 takes no account of gas pressure conditions such as suction pressure, discharge pressure, the kind of a gas being compressed and the like, and so satisfactory results can not be always obtained in a general use where the gas pressure conditions are changed.

BRIEF SUMMARY OF THE INVENTION

The invention has been made in view of the disadvantages in the above-described prior art, and has its object to provide a lobe profile configuration of a screw rotor, with which tooth separating vibration is hard to generate even under various gas pressure conditions. Further, it is another object of the invention to realize a screw fluid machine, which can be operated in a quiet manner under a variety of operating conditions.

In order to achieve the objects mentioned above, a first feature of the invention provides a screw fluid machine comprising a male rotor having helical lobes on an outer periphery thereof, a female rotor adapted to mesh with the male rotor to compress a working gas and having helical lobes on an outer periphery thereof, and a casing adapted to receive both the rotors, and wherein a integrating value of a transmission torque from the male rotor to the female rotor for a single lobe of the female rotor is positive.

In order to achieve the objects mentioned above, a second feature of the invention provides a screw fluid machine comprising a male rotor having helical lobes on an outer periphery thereof, a female rotor adapted to mesh with the male rotor to compress a working gas and having helical lobes on an outer periphery thereof, and a casing adapted to receive both the rotors, and wherein lobe profiles of the respective rotors are defined so that a radius at a point of contact on a leading surface side of the female rotor becomes smaller than both of radii at two points of contact on a trailing surface side when the male rotor and the female rotor are a relative positional relationship, in which three points, at which the female rotor contacts with the male rotor or at which the male rotor and the male rotor are disposed nearest to each other, are formed.

In order to achieve the object mentioned above, a third feature of the invention provides a screw fluid machine comprising a male rotor having helical lobes on an outer periphery thereof, a female rotor adapted to mesh with the male rotor to compress a working gas and having helical lobes on an outer periphery thereof, and a casing adapted to receive both the rotors, and wherein lobe profiles of the respective rotors are defined so that a integrating value at a point of contact on a trailing surface side becomes larger than a integrating value at a point of contact in a leading surface side when integrating a radius of a point of contact of the female rotor with respect to a section of an angle of rotation until point of contacts disappear on the trailing surface side after a maximum radius point of the male rotor and a minimum radius point of the female rotor are disposed nearest to each other. Preferably, the number of male rotor lobes is five and the number of the female rotor lobes is six.

In order to achieve the object mentioned above, a fourth feature of the invention provides a screw fluid machine comprising a female rotor having helical lobes, a male rotor adapted to mesh with the male rotor and having helical lobes, and a casing adapted to receive the pair of the rotors, and wherein, when a leading surface in cross section perpendicular to an axis of the female rotor is divided into a first range between a lobe bottom and a point of inflection and a second range between the point of inflection and a lobe tip, a configuration of the leading surface inverts a sign of positive and negative of curvature before and behind the point of inflection and a curvature distribution of the lobe profile generally increases in the first range.

Preferably, in the fourth feature, the curvature between the lobe bottom and the point of inflection continuously increases in the first range, the curvature distribution of lobe profile monotonously increases in the first range, the curvature distribution of lobe profile in the first range includes at least one point of discontinuity, and the curvature distribution of lobe profile in the first range has a range of a constant curvature.

More preferably, in the first feature, when a leading surface in cross section perpendicular to an axis of the female rotor is divided into a first range between a lobe bottom and a point of inflection and a second range between the point of inflection and a lobe tip, a configuration of the leading surface inverts a sign of positive and negative of curvature before and behind the point of inflection and a curvature distribution of the lobe profile generally increases in the first range. Then, it is desired that the number of male rotor lobes is five and the number of the female rotor lobes is six.

DETAILED DESCRIPTION OF THE INVENTION

In a screw fluid machine, when a male rotor and a female rotor rotate in meshing with each other, points, at which lobe faces of the both rotors come into contact with each other and at which they approach each other with a slight clearance therebetween, appear, and these points repeatedly generate, move and disappear as rotation goes on. Points, at which the lobe faces approach each other, can be treated in the same manner as points of contact in designing lobe profiles. Here, such points are called points of approach like points of contact, and points of contact and points of approach are generally designated by closest approaching points. At the points of approach, a gap between the lobe faces of the both rotors in cross section perpendicular to axes assumes a minimum value spatially. Since there is a gap between the lobe faces of the both rotors, the points of approach are not a single point in a geometrically strict sense, but become two points on the respective lobe faces of the female and male rotors. In the case where a fundamental performance of a screw fluid machine is met, the points of approach can be essentially handled as a single point since the gap is small.

In actual rotors, the reason why points of approach and points of contact do not coincide with each other is that a gap is necessary between the rotors because of working errors, thermal deformation and gas loaded deformation of the rotors. Points of approach and points of contact satisfy the meshing condition in mechanics, that is, "a common normal line at a point of contact (point of approach) passes through a pitch point". In addition, a point of approach becomes sometimes a point of contact when spaced to some extent from a reference angle, but they are not geometrically different from each other.

On the above assumption, several embodiments in accordance with the invention will be described below with reference to the accompanying drawings.

Figure 1:
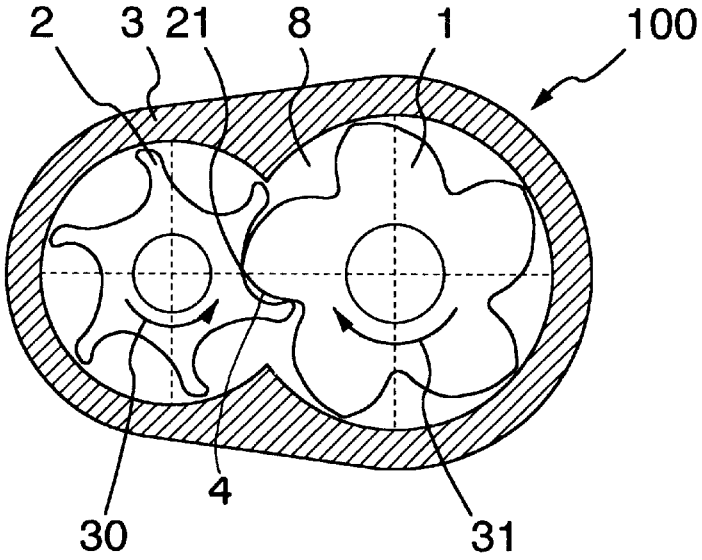
FIG. 1 is a schematic, cross sectional view showing an embodiment of a screw fluid machine in accordance with the invention.

In FIG. 1, a male rotor 1 and a female rotor 2, which have helical lobes in an axial direction and mesh with each other, are rotatably received within a casing 3. A working gas is confined in a compression chamber 4 formed in gear grooves of the both rotors 1 and 2, and is compressed by the both female and male rotors 1 and 2 rotating in rotating directions 30 and 31. Numbers of the lobes on the both rotors are typically such that the male rotor has five lobes and the female rotor has six lobes.

In accordance with the meshing condition in mechanics, if a lobe profile on a leading surface of the female rotor, the numbers of lobes of the female and male rotors and a central distance between the female and male rotors are determined, a lobe profile configuration on the leading surface of the male rotor in mesh with the female rotor is univocally determined. Further, configuration of trailing surfaces of the female and male rotors are defined in a manner to enable making a blow hole small. The configuration of the trailing surfaces is described in details in "Research on rotor lobe profile of screw compressors" (Tamura et al., Japan Society of Mechanical Engineers, Papers, C Edition, Vol. 62, 597, page 357, 1996). In addition, leading and trailing surfaces will be described later in details.

In an optional cross section perpendicular to an axis, the both rotors are made to mesh with each other to be rotated on respective centers of rotation. At this time, an angle of rotation, at which a point (hereinafter, referred to as a lobe tip point) located on an outermost peripheral portion of the male rotor and having a maximum radius and a point (hereinafter, referred to as a lobe bottom point) located on a lobe bottom of the female rotor and having a minimum radius are disposed nearest to each other, is taken as a reference angle.

Depending upon an angle of rotation indicative of positions of the male and female rotors in a circumferential direction, the both rotors 1 and 2 contact with each other at one to three locations on the lobe faces. In addition, for the reason of the need of avoiding injury on lobes, the male rotor lobe and the female rotor lobe sometimes do not contact with each other each other but approach each other with a slight gap therebetween. For the purpose of avoiding complicated explanation, a case will be explained, in which the male rotor and the female rotor contact with each other without any gap therebetween. In the case where the female rotor and the male rotor approach each other with a gap, the invention can be applied as it is when the actual point of approach is regarded as a point of contact.

Figure 2:
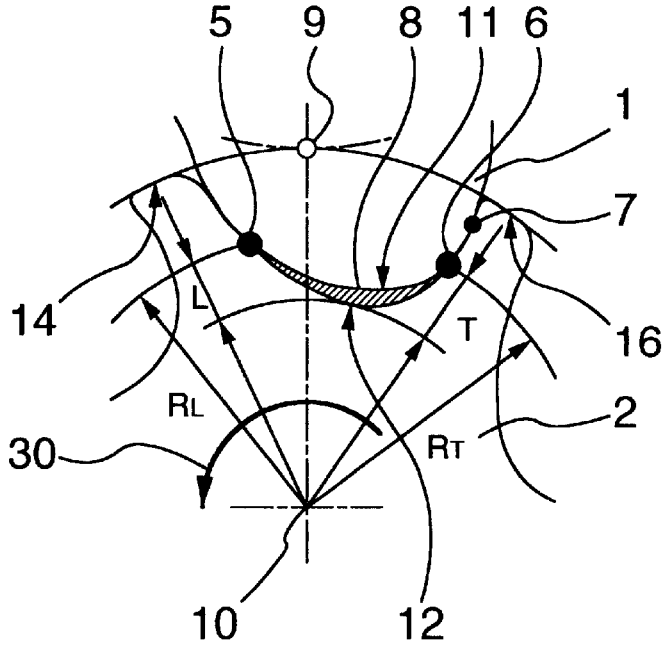
FIG. 2 is a detailed view showing meshing portions of a male rotor and a female rotor shown in FIG. 1.

When relative positions of the male rotor 1 and the female rotor 2 assume a rotating angle shown in FIG. 2, there are produced three points of contact. These points of contact comprise a point 5 on a leading surface side and two points 6 and 7 on a trailing surface side. In addition, leading surfaces designate a section from a lobe tip point 11 at a maximum radius to a lobe bottom in a direction of rotation for the male rotor, and a section from a lobe bottom point 12 having a minimum radius to a lobe tip 14 in a direction of rotation 30 for the female rotor. Further, trailing surfaces designate a section from the lobe tip point 11 to the lobe bottom in an opposite direction of rotation for the male rotor, and a section from the lobe bottom point 12 to a lobe tip 16 for the female rotor. The male rotor 1 and the female rotor 2 contact with each other at their respective leading surfaces and respective trailing surfaces. In addition, the lobe bottom of the male rotor 1 and the lobe tip of the female rotor 2 are positioned on a circular arc about an axis of rotation and are adapted to contact with each other.

A radius of the female rotor 2 at the point of contact 5 on the leading surface side is designated by $R_L$, and a length obtained by subtracting a radius of the lobe bottom of the female rotor 2 from $R_L$ is designated by L. In a similar manner, a radius of the female rotor 2 at the point of contact 6 of a smaller radius of the female rotor 2 among two points of contact on the trailing surface side is designated by $R_T$, and a length resulted from subtracting the radius of the lobe bottom of the female rotor 2 from $R_T$ is designated by T. A crescent area bounded by the point of contact 5 on the leading surface side and the point of contact 6 on the trailing surface side and interposed between the female rotor and the male rotor is called a working chamber 8. The working chamber 8 is filled with a working gas being compressed. An internal pressure of the working chamber 8 is highest near a discharge end surface on an axial end of the rotor.

In the present embodiment, $L \leqq T$ is established at any angles of rotation as far as points of contact exist on both sides of the leading surface and the trailing surface. That is, the lobe profile is formed so that the relation $R_L \leqq R_T$ is established. This formula is met at a position of an angle of rotation shown in FIG. 2.

In conventional screw fluid machines, L>T, that is, $R_L > R_T$ is sometimes established depending upon positions of relative rotation of the male rotor and the female rotor. When positions of points of contact on the leading surface and the trailing surface meet the relation mentioned above, a negative gas torque is generated on the female rotor to tend to generate tooth separating vibration.

In the working chamber 8, an internal pressure acts on lobe profile portions of the male rotor 1 and the female rotor 2. A component of the internal pressure projected in a direction of rotation makes a gas torque acting on the male rotor 1 and the female rotor 2. The component of projection equals to a component of the internal pressure acting on portions shown by the reference characters L, T in the direction of rotation. That is, a negative torque corresponding to L acts on the female rotor in the direction of rotation, and a positive torque corresponding to T acts in a direction of opposite rotation.

Figure 12:
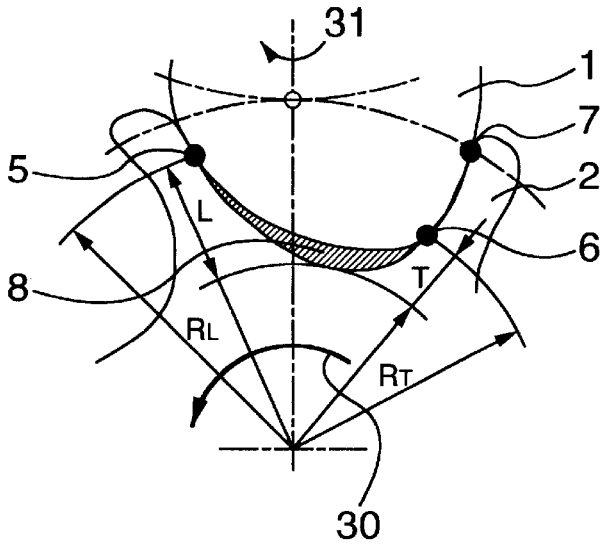
FIG. 12 is a view illustrating tooth separating torque.

In a conventional screw fluid machine shown in FIG. 12, axial cross sections meeting the relation L>T are included in lobe profiles of the both rotors. In this cross sections, the female rotor 2 bears a negative gas torque caused by a gas pressure within the working chamber 8. Of course, since rotor lobes are helical in an axial direction and a gas pressure of certain level acts on lobe faces except a portion, in which the working chamber 8 is formed, a total torque obtained by summing up torque acting on respective cross sections in the axial direction is not always negative.

However, in the case where a suction throttle valve is throttled in a screw compressor, a suction pressure decreases and a gas torque acting on a female rotor at a certain angle of rotation becomes instantaneously negative. In this case, the female rotor is drivingly rotated by a greater gas torque than a transmission torque transmitted from a male rotor, so that any transmission torque is not transmitted from the male rotor to the female rotor. Then, the female rotor rotates ahead of the male rotor, and so trailing surfaces of the both rotors collide with each other. When the rotation goes on further and the gas torque applied to the female rotor returns positive, the state returns from the contact of the trailing surfaces to normal contact of the leading surfaces. As a result, the lobe faces of the male rotor and of the female rotor are made again to collide with each other. Thereafter, this phenomenon is repeated, and so tooth separating vibration is generated.

In contrast, with the embodiment, $L \leqq T$ is established wherever relative positions of the lobes of the male rotor 1 and the lobes of the female rotor 2 are positioned, that is, whatever an angle of rotation is. Accordingly, any negative gas torque is not generated in all cross sections in the axial direction. Therefore, however the pressure condition varies, a total torque acting on the female rotor can be always made positive to thereby prevent tooth separating vibration. Accordingly, the screw fluid machine can be quietly operated in a wide operating range.

Figure 7:
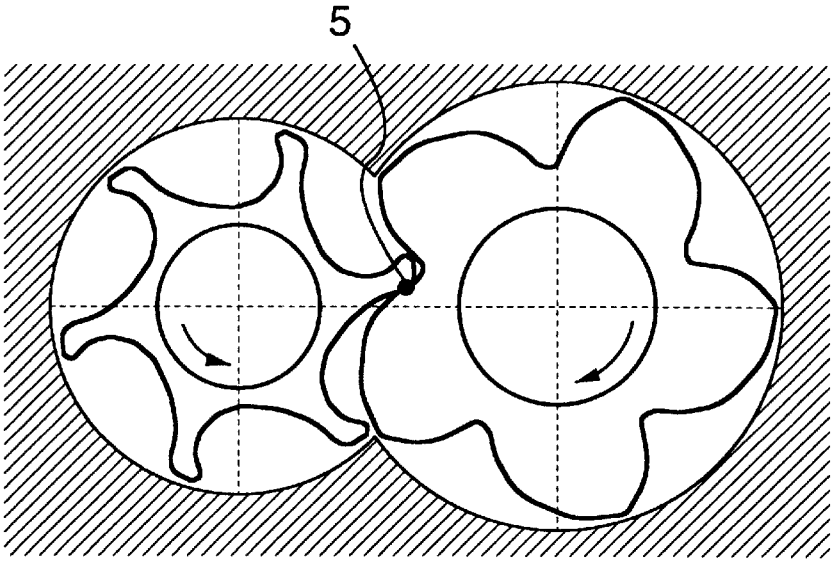
Figure 8:
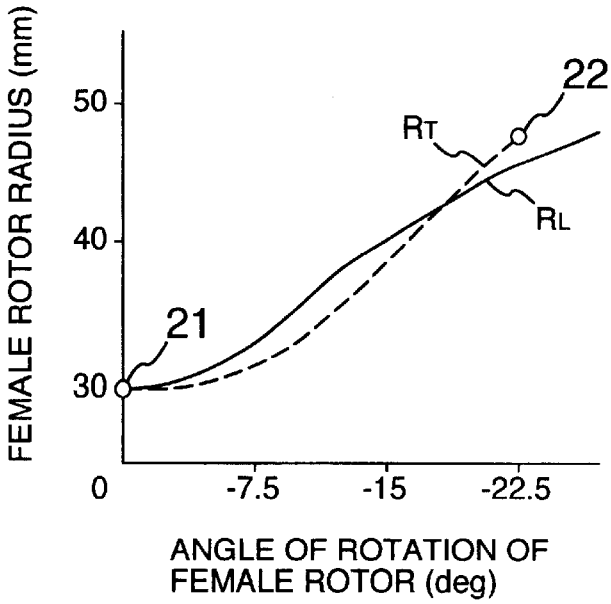
FIG. 8 is a view showing a lobe profile of a conventional screw rotor.
Figure 9:
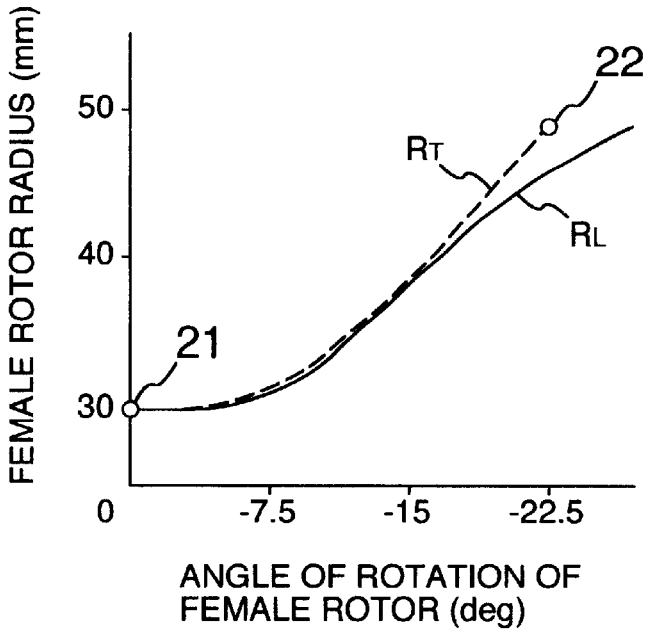
FIG. 9 is a graph illustrating an embodiment of the lobe profile formed on the rotor shown in FIG. 1.
Figure 10:
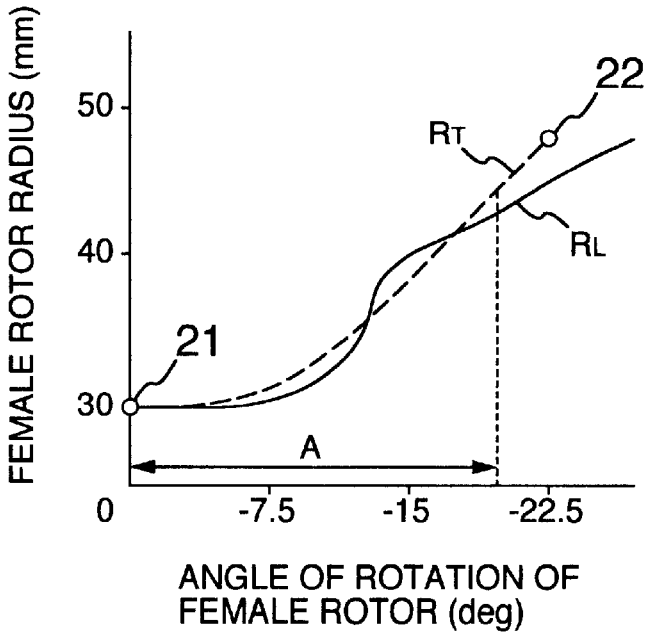
FIG. 10 is a graph illustrating another embodiment of the lobe profile formed on the rotor shown in FIG. 1.

Another embodiment of the invention will be described with reference to FIGS. 3 to 10. FIGS. 3 to 7 are views showing a manner, in which a male rotor and a female rotor mesh with each other, and a state, in which the both rotors are received in a casing, by way of cross section perpendicular to an axis. FIGS. 8 to 10 are graphs illustrating a state, in which a radius of the female rotor changes depending upon a change in point of contact.

Figure 3:
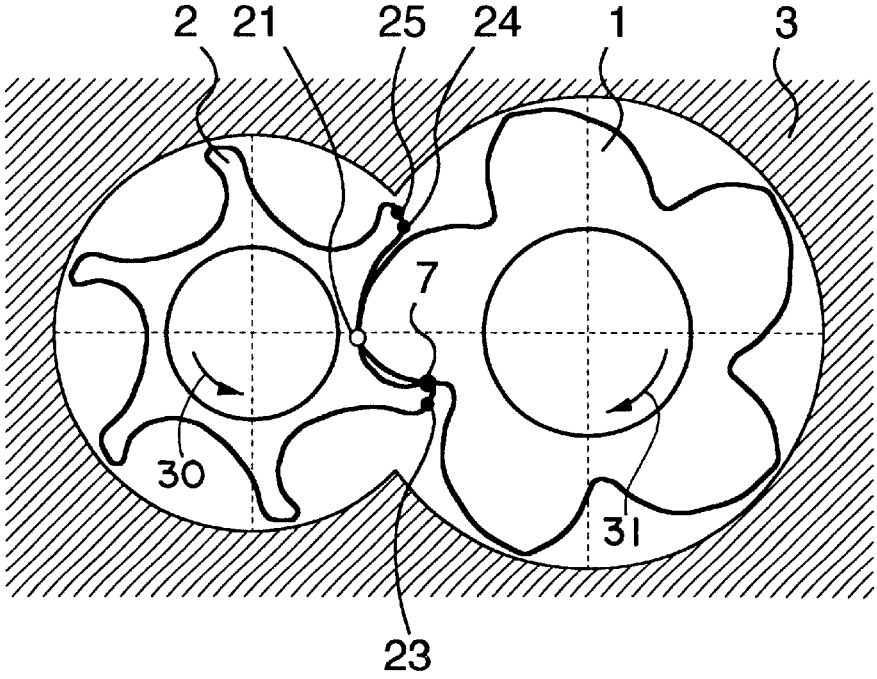
FIGS. 3 to 7 are transverse, cross sectional views showing meshing between the rotors, and the rotors.

A position in FIG. 3 is set as a reference angle 0 degree. When the male and female rotors rotate in the direction of rotation 31 and 30, a point of contact shifts in the direction of rotation, and the lobes do not come into contact with each other after a contact terminating point 21. In addition, a further point of contact 7 is formed on the trailing surface at the angle of rotation 0 degree.

Figure 4:
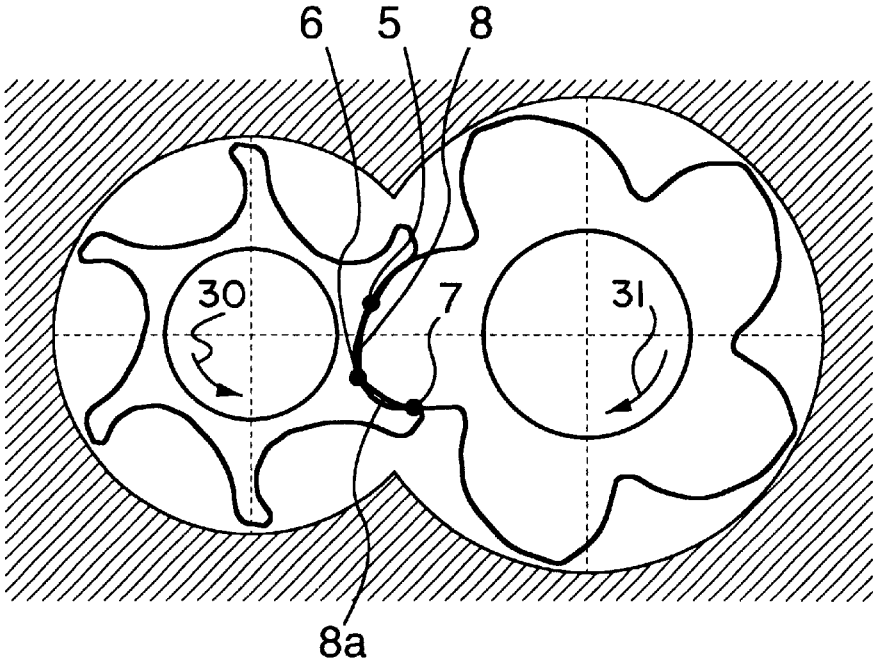

The male rotor 1 and the female rotor 2 are made to synchronously rotate in opposite direction 30 and 31 in operation. When the male rotor is rotated −9 degrees (where the direction of rotation in operation is positive) on the basis of a lobe ratio between the female rotor and the male rotor, the female rotor rotates −7.5 degrees. This state is shown in FIG. 4. The contact terminating point 21 shown in FIG. 3 is divided into two points to provide a point of contact 5 on the leading surface side and a point of contact 6 on the trailing surface side. A narrow area bounded by the point of contact 5 and the point of contact 6 and interposed between the both rotor lobe faces makes a working chamber 8 having a high pressure. On the other hand, an area bounded by the point of contact 5 and the point of contact 6 and interposed between the both rotor lobe faces makes a working chamber **8*a* in suction stroke. The working chamber 8*a*** is low in pressure to give a small influence on the torque.

Figure 5:
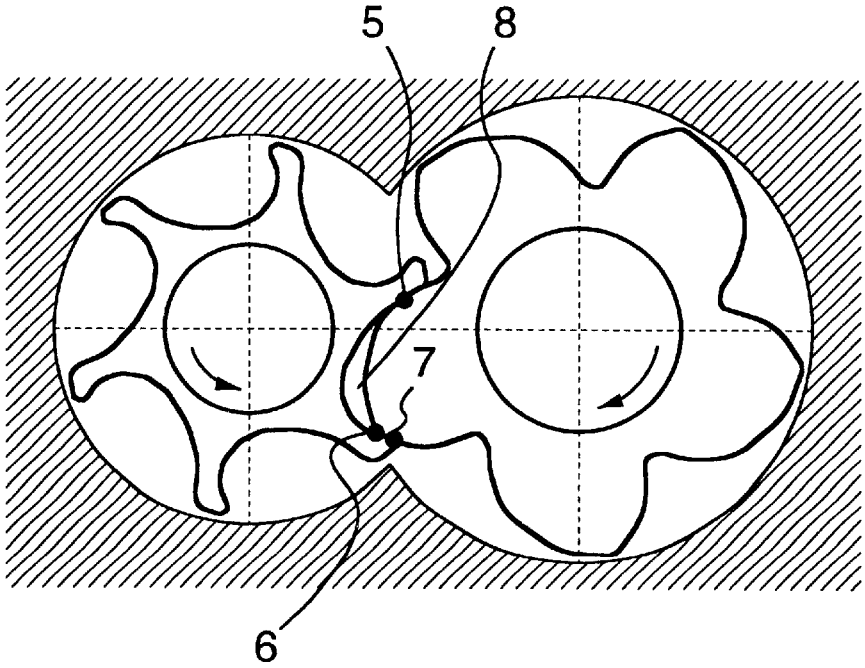
Figure 6:
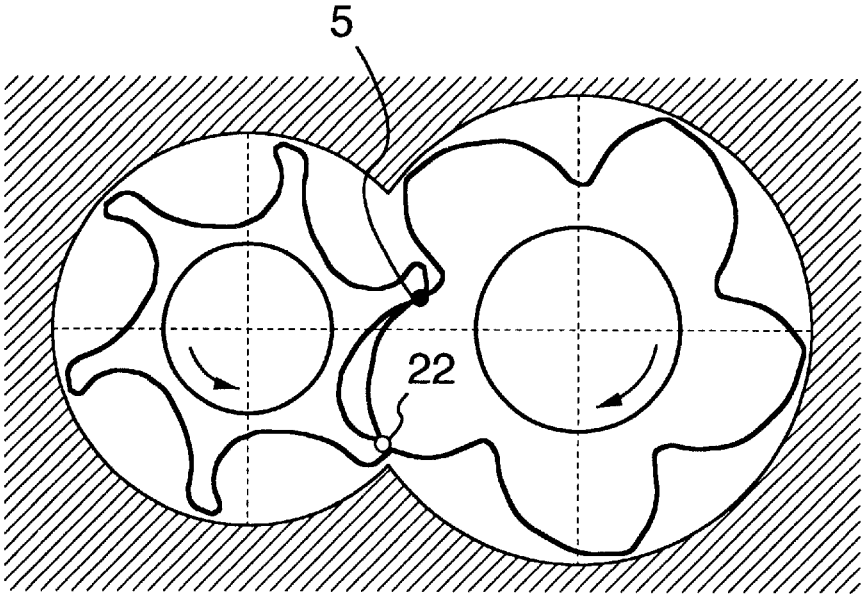

When the male rotor 1 and the female rotor 2 are further rotated in the same direction, it goes onto a state shown in FIG. 6 (the male rotor is at −27 degrees and the female rotor is at −22.5 degrees) from a state shown in FIG. 5 (the male rotor is at −18 degree and the female rotor is at −15 degrees). In the state shown in FIG. 6, two points of contact 6 and 7 on the trailing surface side coincide with each other to make a contact starting point 22. When rotation goes on further, the contact on the trailing surface is terminated and the point of contact 5 is formed only on the leading surface side as shown in FIG. 7 (the male rotor is at −36 degrees and the female rotor is at −30 degrees).

FIGS. 9 and 10 show changes in radius of the female rotor at the points of contact 5 and 6, relative to a progress of the rotation mentioned above and represented in abscissa. For the purpose of comparison, the case for a conventional lobe profile is shown in FIG. 8. In these drawings, the abscissa indicates an angle of rotation of the female rotor and a direction of rotation opposite to that in operation is taken as a positive direction on the abscissa. Accordingly, the origin is 0 and a rightward direction is a direction of negative rotation. A radius $R_L$ of the female rotor at the point of contact 5 on the leading surface side is shown by a solid line and a radius $R_T$ of the female rotor at the point of contact on the trailing surface side is shown by a broken line. In addition, a diameter of the female rotor 2 is 100 mm in FIGS. 9 and 10.

In the case where the angle of rotation is 0 degree, the radii of the points of contact 5 and 6 on the leading surface and the trailing surface become equal to the radius 30 mm of the lobe bottom, and coincide with the contact terminating point 21. In a position where the female rotor rotates −22.5 degrees, the point of contact 6 on the trailing surface side makes the contact starting point 22. Then, at the angle of rotation, at which the rotors have rotated further therefrom in a direction of rotation opposite to that in operation, the lobes formed on the male rotor and the female rotor do not contact with each other. Accordingly, when the angle of rotation becomes equal to or less than −22.5 degrees, $R_T$ does not exist. Here, although the angle of rotation, at which the contact starting point 22 exists, is assumed to be −22.5 degrees in the present embodiment, it goes without saying that such angle changes depending upon the lobe profile and the number of lobes.

As mentioned in the embodiment shown in FIG. 1, with the conventional lobe profile, cross sections where $R_T<R_L$ is established exist in the axial direction, and a negative gas torque is generated on the female rotor. As a result, tooth separating vibration generated. However, the lobe profile of the present embodiment is used to meet $R_T \leqq R_L$ at any angles of rotation, as shown in FIG. 9. Accordingly, any negative gas torque is not generated on the female rotor and any tooth separating vibration is not generated.

FIG. 10 shows changes in radius of a female rotor at points of contact in a screw rotor having the same lobe profile as that in the present embodiment. With the reference angle 0 degree as a starting point, an area A of integration A is set, which has as a terminating point an optional angle up to the contact starting point 22 (−22.5 degrees). In the area of integration A, a radius $R_L$ of the female rotor at the point of contact 5 on the leading surface side and a radius $R_T$ of the female rotor at the point of contact 6 on the trailing surface side are integrated, and values of integration are designate by $T_L$ and $T_T$. These values are represented by an area below a line, which indicates the radius of the female rotor in the area A of integration in FIG. 10. The area thus found forms lobe profiles, which meet $T_L \leqq T_T$, on the male rotor and the female rotor. In addition, as far as the condition $T_L \leqq T_T$ is met, sections, for which $R_L>R_T$ establishes, may exist partly.

In the vicinity of discharge end surfaces of the rotors, the working chamber 8 contracts in the order of FIG. 6→FIG. 5→FIG. 4→FIG. 3 as the rotors go on rotating. At the discharge end surface, the working chamber 8 completes compression of the working gas to discharge the gas out of the machine. Then, in the state shown in FIG. 3, the point of contact coincides with the contact terminating point at the point of lobe bottom 21, and the working chamber 8 disappears. The working chamber 8 formed at the discharge side end surfaces is high in pressure, which can be responsible for generation of the negative gas torque on the female rotor. The gas torque acting on the female rotor is expressed by a formula $k\cdot(R_T-R_L)$ every cross section. Here, k is a constant. Integration of $(R_T-R_L)$ found every cross section in the axial direction provides a total gas torque.

Figure 11:
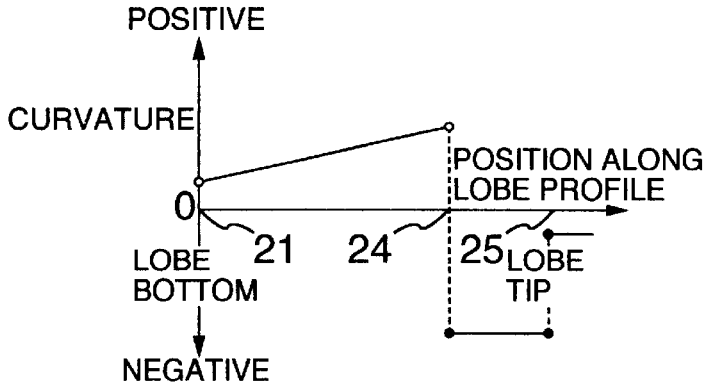
FIG. 11 is a graph illustrating a curvature of a leading surface in another embodiment of the lobe profile formed on the rotor shown in FIG. 1.

FIG. 11 shows an example of a distribution of a curvature of the lobe profile of the female rotor. Ordinate indicates a curvature κ of a lobe profile curve on the leading surfaces 21 to 24 to 25 and abscissa indicates a length along the lobe profile curve. Here, a point 24 indicates a point of inflection. The lobe profile curve is formed so that the curvature κ continuously increases in a section from a point of lobe bottom 21 to the point of inflection 24. The lobe profile curve may be elliptical, exponential, a line generated by the mating lobe profile, a combination of them or the like. That is, the lobe profile of the female rotor may be such that the curvature κ shown in FIG. 11 increases monotonously, and it is not required that an increasing rate of the curvature is constant.

The curvature κ of the lobe profile curve is reversed in sign beyond the point of inflection 24. When this is shown in FIG. 3, a center of curvature exists on the right side of the lobe profile curve in the range of the lobe profile curve connecting the points 21 and 24, while a center of curvature exists on the left side of the lobe profile curve in the range of the lobe profile curve connecting the points 24 and 25. That is, the center of curvature is switched over at the point 24 and up to the point of lobe tip 25 with the curvature kept negative in sign. The leading surface of the lobe profile of the male rotor is univocally determined by the geometric calculation on the basis of a condition, under which it meshes with the leading surface of the lobe profile of the female rotor.

Hereupon, in the present embodiment, the curvature of the female rotor is made to continuously increase from the lobe bottom to the lobe tip, and is reversed in sign at the point of inflection while being kept as it is up to the outer periphery of the lobe tip. Further, the point of inflection is positioned nearer the point of lobe tip than the point of lobe bottom. It goes without saying that the invention is not limited to this. For example, the curvature curve of the leading surface of the female rotor may include a certain section or sections where the curvature is constant, and a point or points of discontinuity on the curvature. In such case, a lobe profile is desired, in which a value of its curvature is gradually increased as a whole and the curvature is reversed in sign at the point of inflection and goes onto the lobe tip. In addition, "as a whole" means that an inclination of a least square approximate straight line for a row of dots disposed on that graph at regular intervals becomes positive, in which graph a curvature in a range between the lobe bottom and the point of inflection is represented on ordinate and a length extending along the lobe profile from the lobe bottom is represented on abscissa. Then, a section, in which the curvature decreases, comprises a section extending between the lobe bottom and the point of inflection and amounts to 10% or less of the total length of the section.

In the respective embodiments, in which the curvature of the lobe profile is defined in such a manner, the point of contact 5 on the leading surface side can be reduced in radius of rotation $R_L$. That is, in the position of the angle of rotation shown in FIG. 3 where meshing is completed, the point of contact 5 on the leading surface side and the point of contact 6 on the trailing surface side coincide with each other to make a point 9. When rotating reversely from the position of angle, the point 9 is divided into two points to present the positional relationship shown in FIG. 5. In FIG. 5, in order to reduce L and $R_L$, it is desired that the point of contact 5 be positioned not to be away from the center of the female rotor, and the lobe profile make a curve like a straight line between the point of lobe bottom 21 and the point of contact 5. That is, it suffices that the curvature be small from the point of lobe bottom 21 to the point of contact 5 (condition A).

Meanwhile, an angle defined by the lobe profile is 360 degrees/the number of lobes. Because the female rotor 2 is six in number in the respective embodiments mentioned above, a single lobe must be formed with 60 degrees or less. Accordingly, a portion or portions having a large curvature always appear on the leading surface of the female rotor (condition B). Further, a distance between points on the lobe tip of the female rotor is made small.

Curvatures required for the lobe profile in this manner contradict each other in the condition A and the condition B. With the respective embodiments mentioned above, however, such problem is solved in the following manner. That is, because $R_L$ is much affected in the range near the point of lobe bottom 21, the condition A is made preferential to make the curvature small. Accordingly, $R_L$ becomes small. As it goes away from the point of lobe bottom 21, the curvature is made large to become maximum at the point of inflection 24. Therefore, the distance between the points on the lobe tip of the female rotor can be reduced. The curvature is reversed beyond the point of inflection 24 for the reason of avoiding interference on lobe profile or the like, and further up to the point of lobe tip 25. In accordance with the embodiment, the lobe profile is found from the distribution of the curvature of the lobe face curve, which defines the lobe profile, so that it is possible to easily obtain a screw rotor, which prevents tooth separating vibration.

Figure 13:
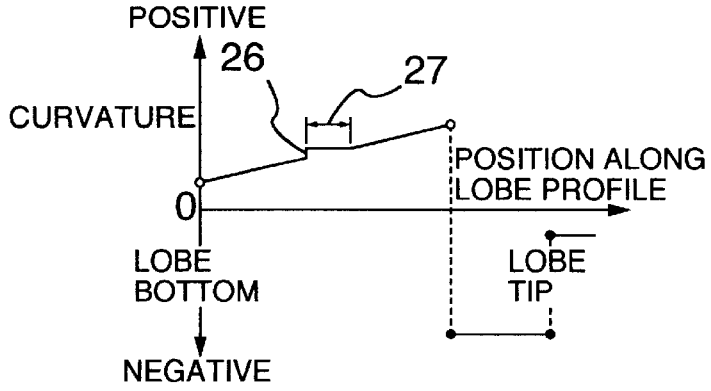
FIG. 13 is a graph illustrating a curvature of a leading surface in a still further embodiment of the lobe profile formed on the rotor shown in FIG. 1.

A further embodiment of the invention will be shown in FIG. 13. The present embodiment is different from the embodiment shown in FIG. 11 in that points of discontinuity are included in the curvature distribution of the leading surface of the female rotor. The curvature κ of the lobe profile of the leading surface of the female rotor includes between the point of lobe bottom 21 and the point of inflection 24 of the lobe tip, a point of discontinuity 26 and a section 27 where the curvature is constant. In spite of the existence of such point of discontinuity and such section where the curvature is constant, the curvature κ gradually increases as a whole in the section extending from the point of lobe bottom 21 to the point of inflection 24 of the lobe tip. The point of discontinuity 26 and the section 27 where the curvature is constant may be plural. Further, the curvature K may increases as a whole in the section 27 where the curvature is constant from the point of lobe bottom 21 toward the point of inflection 24. In addition, when the point of discontinuity 26 and the curvature fixed section 27 are small, the lobe profile will be substantially the same in appearance as that in the embodiment shown in FIG. 11. However, measurement of configuration by means of a precision measuring instrument reveals that lobe profiles in the both cases are different from each other.

In accordance with the present embodiment, continuously increasing of the curvature of the lobe profile does not need the use of a complicated curve or curves. Accordingly, the lobe profile can be formed by connecting curves of ease processing such as elliptical, parabolic, and the like, so that design and work of the lobe profile are made easy.

As mentioned above, it is possible according to the invention to prevent tooth separating vibration in a screw fluid machine such as screw compressors, vacuum pumps and the like, so that the screw fluid machine can be quietly operated. Further, in accordance with the invention, any negative gas torque is generated on a female rotor of the screw fluid machine even under the condition that suction pressure is low and discharge pressure is high, so that the screw fluid machine can be quietly operated in a wide range of operation.

What is claimed is:

1. A screw fluid machine comprising a male rotor having helical lobes on an outer periphery thereof, a female rotor adapted to mesh with the male rotor to compress a working gas and having helical lobes on an outer periphery thereof, and a casing adapted to receive both the rotors, and wherein lobe profiles of the respective rotors are defined so that a radius at a point of contact on a leading surface side of the female rotor becomes smaller than both of radii at two points of contact on a trailing surface side when the male rotor and the female rotor are a relative positional relationship, in which three points, at which the female rotor contacts with the male rotor or at which the female rotor and the male rotor are disposed nearest to each other, are formed.

2. A screw fluid machine comprising a male rotor having helical lobes on an outer periphery thereof, a female rotor adapted to mesh with the male rotor to compress a working gas and having helical lobes on an outer periphery thereof, and a casing adapted to receive both the rotors, and wherein lobe profiles of the respective rotors are defined so that a integrating value at a point of contact on a trailing surface side becomes larger than a integrating value at a point of contact in a leading surface side when integrating a radius of a point of contact of the female rotor with respect to a section of an angle of rotation until point of contacts disappear on the trailing surface side after a maximum radius point of the male rotor and a minimum radius point of the female rotor are disposed nearest to each other.

3. A screw fluid machine comprising a female rotor having helical lobes, a male rotor adapted to mesh with the male rotor and having helical lobes, and a casing adapted to receive the pair of the rotors, and wherein, when a leading surface in cross section perpendicular to an axis of the female rotor is divided into a first range between a lobe bottom and a point of inflection and a second range between the point of inflection and a lobe tip, a configuration of the leading surface inverts a sign of positive and negative of curvature before and behind the point of inflection and a curvature distribution of the lobe profile generally increases in the first range.

4. The screw fluid machine as claimed in claim 3, wherein the curvature between the lobe bottom and the point of inflection continuously increases in the first range.

5. The screw fluid machine as claimed in claim 3, wherein the curvature distribution of lobe profile monotonously increases in the first range.

6. A screw fluid machine comprising a male rotor having helical lobes on an outer periphery thereof, a female rotor adapted to mesh with the male rotor to compress a working gas and having helical lobes on an outer periphery thereof, and a casing adapted to receive both the rotors, wherein an integrating value of a transmission torque from the male rotor to the female rotor for a single lobe of the female rotor is positive, and wherein when a leading surface in cross section perpendicular to an axis of the female rotor is divided into a first range between a lobe bottom and a point of inflection and a second range between the point of inflection and a lobe tip, a configuration of the leading surface inverts a sign of positive and negative of curvature before and behind the point of inflection and a curvature distribution of the lobe profile generally increases in the first range.

7. The screw fluid machine as claimed in one of claims 4 to 6, wherein the curvature distribution of lobe profile in the first range includes at least one point of discontinuity.

8. The screw fluid machine as claimed in any one of claims 4 to 6, wherein the curvature distribution of lobe profile in the first range has a range of a constant curvature.

9. The screw fluid machine as claimed in claims 3 or 6, wherein the number of male rotor lobes is five and the number of the female rotor lobes is six.

* * * * *